US011008720B2

(12) United States Patent
Kirby

(10) Patent No.: US 11,008,720 B2
(45) Date of Patent: May 18, 2021

(54) FLOATING DOCK PILING HEIGHT EXTENSION ASSEMBLY AND METHOD

(71) Applicant: Adam Kirby, Pawleys Island, SC (US)

(72) Inventor: Adam Kirby, Pawleys Island, SC (US)

( * ) Notice: Subject to any disclaimer, the term of this patent is extended or adjusted under 35 U.S.C. 154(b) by 0 days.

(21) Appl. No.: 16/159,118

(22) Filed: Oct. 12, 2018

(65) Prior Publication Data

US 2020/0115867 A1 Apr. 16, 2020

(51) Int. Cl.

| | |
|---|---|
| ***B63B 35/34*** | (2006.01) |
| ***B63B 35/38*** | (2006.01) |
| ***B63C 1/02*** | (2006.01) |
| ***E02D 5/60*** | (2006.01) |
| ***E02B 3/06*** | (2006.01) |
| ***E02B 3/24*** | (2006.01) |

(52) U.S. Cl.
CPC ..... *E02B 3/064* (2013.01); *E02B 3/24* (2013.01)

(58) Field of Classification Search
CPC ..... E02B 3/064; E02B 3/24; E02B 17/0017; B63B 35/34; B63B 35/38; B63B 2021/504; B63B 2737/00; B63C 1/02; E02D 5/226; E02D 5/60
USPC ..... 405/196, 211, 216, 217, 218, 219, 220, 405/221, 61; 114/230.13, 230.16, 230.17, 114/263, 230.1, 266, 267, 230.11–230.18, 114/230.27, 230.28; 248/65, 67.5, 70, 248/74.4; 441/3
See application file for complete search history.

(56) References Cited

U.S. PATENT DOCUMENTS

| | | | | | |
|---|---|---|---|---|---|
| 2,552,424 | A * | 5/1951 | Gorman | E02B 3/24 | 114/230.1 |
| 2,657,540 | A * | 11/1953 | Templeton | E02B 17/027 | 405/209 |
| 2,873,712 | A * | 2/1959 | Gossen | E02B 3/24 | 114/230.24 |
| RE24,837 | E * | 6/1960 | Usab | E02B 3/064 | 114/266 |
| 2,984,076 | A * | 5/1961 | Bradley | B63B 35/44 | 405/219 |
| 3,060,884 | A * | 10/1962 | Ernest | E02B 3/24 | 114/230.24 |
| 3,122,120 | A * | 2/1964 | Jorgenson | E02B 3/24 | 114/230.27 |

(Continued)

FOREIGN PATENT DOCUMENTS

| | | | | |
|---|---|---|---|---|
| CH | 655967 | A5 * | 5/1986 | E02D 5/30 |

*Primary Examiner* — Edwin J Toledo-Duran
(74) *Attorney, Agent, or Firm* — Southeast IP Group LLC; Thomas L. Moses

(57) ABSTRACT

A system and method for maintaining a connection between a floating dock and a fixed piling during a flood event. The system includes a piling sleeve that is adapted to telescopically and slidably fit over and around a fixed piling, wherein the piling is fixed into the ground below the surface of the water, and extends upwardly through an opening in a floating dock. The piling sleeve includes a catch mechanism attached to an upper portion of the piling sleeve. The catch mechanism is designed to "catch" or engage the floating dock when the dock rises with the water to a pre-determined level. The piling sleeve may freely slide upwardly and downwardly with respect to both the piling and floating dock, and when flood waters rise, the catch mechanism causes the sleeve to rise with the dock while maintaining an extended connection to the piling.

12 Claims, 10 Drawing Sheets

(56) References Cited

U.S. PATENT DOCUMENTS 3,131,542 A * 5/1964 Koch ..... E02B 3/064 405/219
3,238,912 A * 3/1966 Perlick ..... E02B 3/24 114/230.1
3,430,598 A * 3/1969 Soderberg ..... E02B 3/24 114/230.27
3,462,960 A * 8/1969 Bruehl ..... E02B 3/24 405/214
3,495,565 A * 2/1970 Gustavii ..... E02B 3/24 114/230.1
3,543,523 A * 12/1970 Nelson ..... E02D 5/52 405/227
3,614,871 A * 10/1971 Nordell ..... E02B 3/068 405/221
3,695,209 A * 10/1972 Giese ..... E02B 3/24 114/230.24
3,842,779 A * 10/1974 Jaynes ..... B63B 21/00 114/230.24
3,952,528 A * 4/1976 Donkersloot ..... E02B 3/068 405/221
4,028,899 A * 6/1977 Carmichael, III ..... E02B 3/064 405/219
4,043,287 A * 8/1977 Shorter, Jr. ..... B63B 35/38 114/266
4,070,980 A * 1/1978 Shorter, Jr. ..... E02B 3/064 114/263
4,087,977 A * 5/1978 Kuhlman ..... E02B 3/068 108/83
4,110,989 A * 9/1978 Selkirk ..... E02D 5/24 405/248
4,212,564 A * 7/1980 Kay ..... E02B 3/064 114/263
4,286,897 A * 9/1981 Suskind ..... E02B 3/068 248/231.31
4,365,577 A * 12/1982 Heinrich ..... B63B 35/34 114/267
4,493,283 A * 1/1985 Elliott ..... B63B 22/02 114/230.13
4,647,257 A * 3/1987 Robishaw ..... E01D 15/133 405/204
4,890,959 A * 1/1990 Robishaw ..... E01D 21/00 405/204
4,923,336 A * 5/1990 Schmidt ..... E02B 3/068 405/216
4,968,182 A * 11/1990 Westwell ..... E02B 3/064 405/215
4,981,397 A * 1/1991 Wiltse ..... E02B 3/068 182/179.1
5,007,363 A * 4/1991 James ..... E02B 3/26 114/219
5,090,842 A * 2/1992 Montgomery ..... B63C 3/06 114/44
5,108,230 A * 4/1992 Grootegoed ..... E02B 3/064 405/218
5,301,628 A * 4/1994 Daskalides ..... E02B 3/24 114/230.27
5,341,757 A * 8/1994 Digiacomo ..... B63B 21/00 114/230.27
5,347,949 A * 9/1994 Winston ..... E02B 3/064 114/264
5,762,016 A * 6/1998 Parsons ..... E02B 3/26 114/219
6,112,690 A * 9/2000 Anderson ..... E02B 3/24 114/219
6,145,463 A * 11/2000 Zeilinger ..... B63B 3/06 114/267
6,364,576 B1 * 4/2002 Passen ..... E02B 3/064 114/267
6,648,554 B1 * 11/2003 Sehl ..... B63B 21/50 114/351
6,746,181 B1 * 6/2004 Heintz ..... E02B 3/068 114/263
7,021,230 B1 4/2006 Lawrence
7,121,221 B2 10/2006 Lawrence
7,128,015 B1 * 10/2006 Rogerson ..... E02B 3/064 114/266
7,153,064 B2 * 12/2006 Zeilinger ..... E02B 3/064 405/221
7,188,579 B2 * 3/2007 Lemonides ..... B63B 21/00 114/230.2
7,406,924 B1 * 8/2008 Impey ..... E02B 3/068 114/263
7,921,792 B2 * 4/2011 Lemonides ..... B63B 21/04 114/230.1
8,220,781 B2 * 7/2012 Gray ..... E04H 17/1417 256/65.13
9,388,545 B1 * 7/2016 Wolner ..... E02B 3/068
2005/0268836 A1 * 12/2005 Brine ..... B63B 35/38 114/263
2005/0271477 A1 * 12/2005 Sehl ..... B63B 21/00 405/218
2006/0065179 A1 * 3/2006 Lawrence ..... B63B 21/00 114/230.13
2006/0162636 A1 * 7/2006 Lawrence ..... E02B 3/24 114/230.13
2006/0191460 A1 * 8/2006 Zeilinger ..... E02B 3/064 114/264
2007/0231079 A1 10/2007 Gambill
2009/0090289 A1 * 4/2009 Lemonides ..... B63B 21/04 114/230.1
2013/0087089 A1 * 4/2013 Lill ..... B63B 21/00 114/263
2013/0160691 A1 * 6/2013 Webb ..... B63B 21/00 114/230.18
2013/0176712 A1 * 7/2013 Berg ..... F21V 33/006 362/145
2013/0294841 A1 * 11/2013 Fey ..... E02D 5/64 405/216
2015/0063910 A1 * 3/2015 Meltsov ..... F03B 13/1815 405/21
2016/0083054 A1 * 3/2016 Valtanen ..... B65D 90/12 701/21
2017/0234457 A1 * 8/2017 Sayler ..... F16L 1/06 248/49
2017/0350083 A1 * 12/2017 Fuhrmann ..... B63B 21/50
2018/0266066 A1 * 9/2018 Barnes ..... E02B 3/064

* cited by examiner

FLOATING DOCK PILING HEIGHT EXTENSION ASSEMBLY AND METHOD

BACKGROUND OF THE INVENTION

The present invention relates to floating docks. More specifically, the present invention is directed to a system and assembly for ensuring that docks remain connected to pilings during storm surges, floods, and other events that cause waters to rise.

Many people who live on bodies of water own floating docks. Typically, these docks are constructed with a stationary pier that leads out to a floating portion, which is connected to the pier by a hinged ramp, so that the floating portion of the dock may rise and fall along with fluctuations in the water level. Oftentimes, the floating portion of the dock includes one or more openings to accommodate fixed pilings that are driven into the ground beneath the water. The pilings extend upwardly from the water, through the floating dock openings, and these fixed pilings allow the dock to move upwardly and downwardly with water level fluctuations, but otherwise prevent the floating dock from moving laterally, or floating away from the fixed pier.

Because these docks are typically near the dock owner's home, and are positioned within their view of the water, the dock owners make sure that the pilings do not extend far above the accepted high water mark, so that the pilings to not interfere with their view. Under normal circumstances, having such low-cut pilings does not cause problems. However, when the water level rises to an unusually high level, these low-cut pilings may become completely submerged, causing the floating portion of the dock to completely disengage from the pilings. With the addition of high winds and pounding surf or waves, the floating portion of the dock is at much greater risk of becoming damaged or unmoored from the end of the fixed pier.

Through the years, efforts have been made to address this problem, with varying levels of success. The following are examples of devices for maintaining a connection between a dock and a piling, and each of the references cited below is incorporated herein by reference:

U.S. Pat. No. 4,923,336 Dock Supporting Apparatus

A dock support having a piling composed of an upstanding rod the lower end of which is adapted to be embedded in the bottom of a body of water and an external telescoping sleeve having a cap at its upper end which normally confronts and seats on the upper end of the rod. A passage exists between the confronting surfaces of the inner and outer telescoping members and such passage is occupied by air, rather than water. The air prevents water in the passage rising to the level at which it may freeze, but should water in the passage rise to the freezing level compressed air may be admitted to the passage via a valve under sufficient pressure to purge such water.

U.S. Pat. No. 5,301,628 Boat Docking Post

A docking post includes a tubular housing having a front wall, including an elongate slot directed through the front wall longitudinally aligned relative to the housing and parallel to the housing axis, with the housing having a rear wall mounted to an associated mooring post. A first tube is mounted within the housing, having a securement ring thereon, with a second tube positioned below the first tube having a length adjusted to accommodate a predetermined length between a boat water line and a boat securement cleat. A third buoyant tube is mounted below the second tube to effect displacement of the first and second tube relative to rising and lowering tides and water level relative to the tubular housing.

U.S. Pat. No. 7,021,230 Floatable Dock Mooring Article

A floating dock mooring article, which slidably fits around a watercraft dock pipe, comprising a flotation device attached to a mooring member and a flange generally located at the upper end thereof. A watercraft is moored to the dock, as by a rope, via the flotation mooring article. When the water level rises as due to a flood, the float will cause the mooring article to raise-up the dock pipe and maintain securement of the watercraft to the dock.

U.S. Pat. No. 7,121,221 Floatable Dock Mooring Article

A floating dock mooring article that is movably connected around a watercraft dock pipe comprises a float operatively connected to a mooring member having a flange generally located at the upper end thereof. A watercraft is moored to the dock, as by a rope, via the mooring article. The mooring member has at least one radially outward set projection having an external diameter and the float has at least one radially inward projection having an internal diameter. The mooring member projection external diameter is greater than the float inward projection internal diameter. The inward projection is capable of engaging the mooring member projection so that the float is set at a predetermined height of said mooring member and/or the float is capable of causing the mooring member to rise.

U.S. Application No. 20070231079 Telescoping Piling Apparatus and Method

Embodiments include a piling apparatus for providing support for one or more structures on, in, under, or into a body of water, a floor of the body of water, or a floor bed, comprising at least three concentric and generally coaxial bodies comprising an outer body having a first longitudinal bore therethrough, a middle body having a second longitudinal bore therethrough, the middle body operatively connected to the one or more structures, and an inner body having a third longitudinal bore therethrough, wherein the middle body is disposed between the inner and outer bodies, wherein the inner and outer bodies are operatively connected to one another and the middle body is moveable longitudinally and generally coaxially relative to the inner and outer bodies to stabilize the one or more structures. Embodiments include a method for supporting one or more structures using a piling apparatus. Embodiments include a method of installing piling at a location, comprising providing piling comprising one or more generally concentric tubes; forcing a pressurized fluid into at least one of the tubes; lowering the piling; forming a hole at the location using the pressurized fluid exiting from the piling; and installing the piling at the location.

U.S. Application No. 20130087089 Dock Protector for Use with a Floating Dock

Aspects of the present disclosure are directed to a dock protector apparatus. The apparatus includes an elongated pipe and a flange. A floating dock includes at least one floating dock section coupled to mooring pipes secured to a river or lake bed. The mooring pipes are slidably coupled and to the dock section by pipe sleeve assemblies that enable the dock section to slide vertically along the mooring posts. A dock protector apparatus is inserted within an interior cavity of each mooring pipe. Under tidal surge conditions, the decking may reach a vertical position above a top end of the mooring posts. In order to present the deck section from becoming decoupled from the mooring posts, the dock protector apparatus extends upwardly and remains coupled to both the mooring posts and the dock section, thereby maintaining an essentially laterally-rigid mooring between the dock section and the mooring post.

Each of the aforementioned devices and systems includes significant disadvantages, and it would be desirable to provide a telescoping assembly that may freely move upwardly and downwardly, both with respect to the pilings and a floating dock, while still maintaining a secure connection therebetween to prevent the dock from becoming unmoored from the piling(s).

SUMMARY OF THE INVENTION

In a first embodiment, a piling sleeve is adapted to telescopically engage a fixed piling, wherein the piling is fixed into the ground below a surface of the water, and extends upwardly, either through an opening in a floating dock, or through a U-shaped brace ("U-brace") attached to a side thereof. The piling sleeve preferably includes a catch mechanism attached to an upper portion of the piling sleeve. The catch mechanism is designed to "catch" or engage the floating dock when the dock rises with the water to a pre-determined level. The catch mechanism may take many forms, including a flange around an upper portion of the piling sleeve, a lip, a rod or bolt (or a series of rods or bolts) extending from one side of the piling sleeve, or any other suitable arrangement, so long as it extends radially away from the piling sleeve to engage the upper periphery of the piling opening in the floating dock. The piling sleeve is positioned so that at least an upper portion thereof remains above the top surface (floor) of the floating dock, and the piling sleeve extends downwardly through the piling opening in the floating dock, and extends downwardly below the dock and below the surface of the water, surrounding the piling.

Other features may include an attachment mechanism, such as a cable or sliding track assembly, to tether the piling sleeve to the piling, and may further include lights, cleats, or other features that are affixed to the piling sleeve.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PRESENT INVENTION

Figure 1:
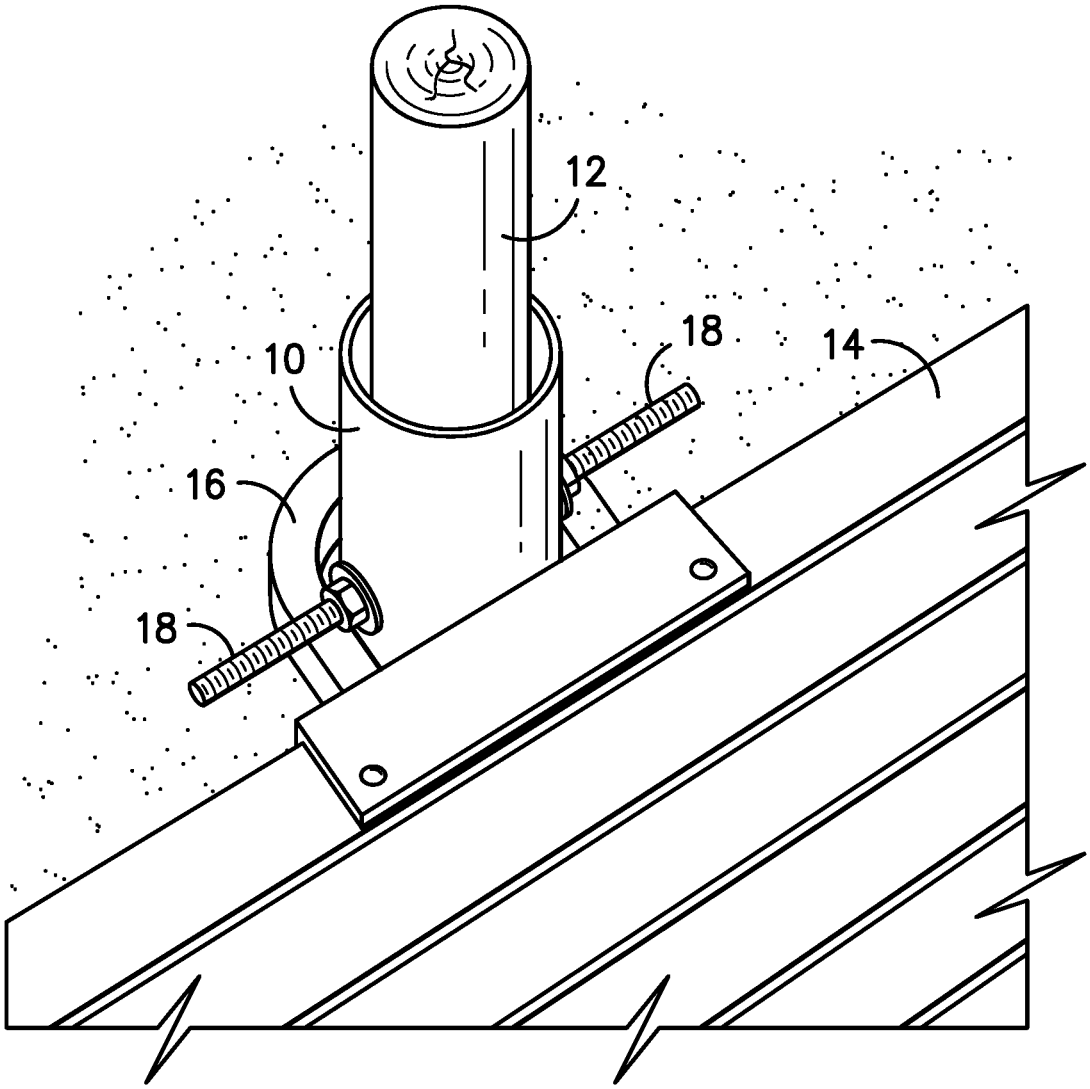
FIG. 1 is a perspective view of one embodiment in accordance with the present invention, wherein a piling sleeve is telescopically disposed about a fixed vertical piling, extending upwardly through a piling opening defined by a U-brace attached to a floating portion of a dock, and wherein the piling sleeve includes a catch mechanism in the form of a bolt disposed through a hole in the piling sleeve and positioned above the U-brace for engagement therewith during high water events.

In a first embodiment, a piling sleeve 10 is telescopically engaged with a fixed vertical piling 12 for a floating dock 14, so that the piling sleeve 10 may slide upwardly and downwardly with respect to the piling 12. The piling 12, in this embodiment, is fixed in the ground beneath the dock 14 and extends upwardly through an opening ("piling opening"), either within the floating portion of the dock 14 itself, or within a U-brace 16 attached to the side of the dock 14, and which allows the floating portion of the dock 14 to rise and fall with fluctuating water levels while preventing significant lateral movement across the surface of the water. A catch mechanism 18 is attached to an upper portion of the piling sleeve 10, and extends outwardly or radially from the piling sleeve 10 in a transverse direction from the longitudinal axis of the piling sleeve 10 and piling 12. The catch mechanism 18 preferably extends outwardly at a distance sufficient to engage the top surface of the floating portion of the dock 14 around the periphery of the piling opening or the U-brace 16, when the water level rises to a predetermined water level.

The piling sleeve 10 is hollow on an inner portion thereof, so that it may fit over and surround a piling 12 in a telescopic manner, and so that the piling sleeve 10 may freely slide upwardly and downwardly along the piling 12. The shape of the piling sleeve 10 may take any desired form, but preferably is a complementary shape with respect to the piling 12. For instance, if the piling 12 is round, then it is preferred (but not required) that the piling sleeve 10 be formed into a round cross-sectional configuration, slightly larger than the diameter of the piling 12.

Figure 5:
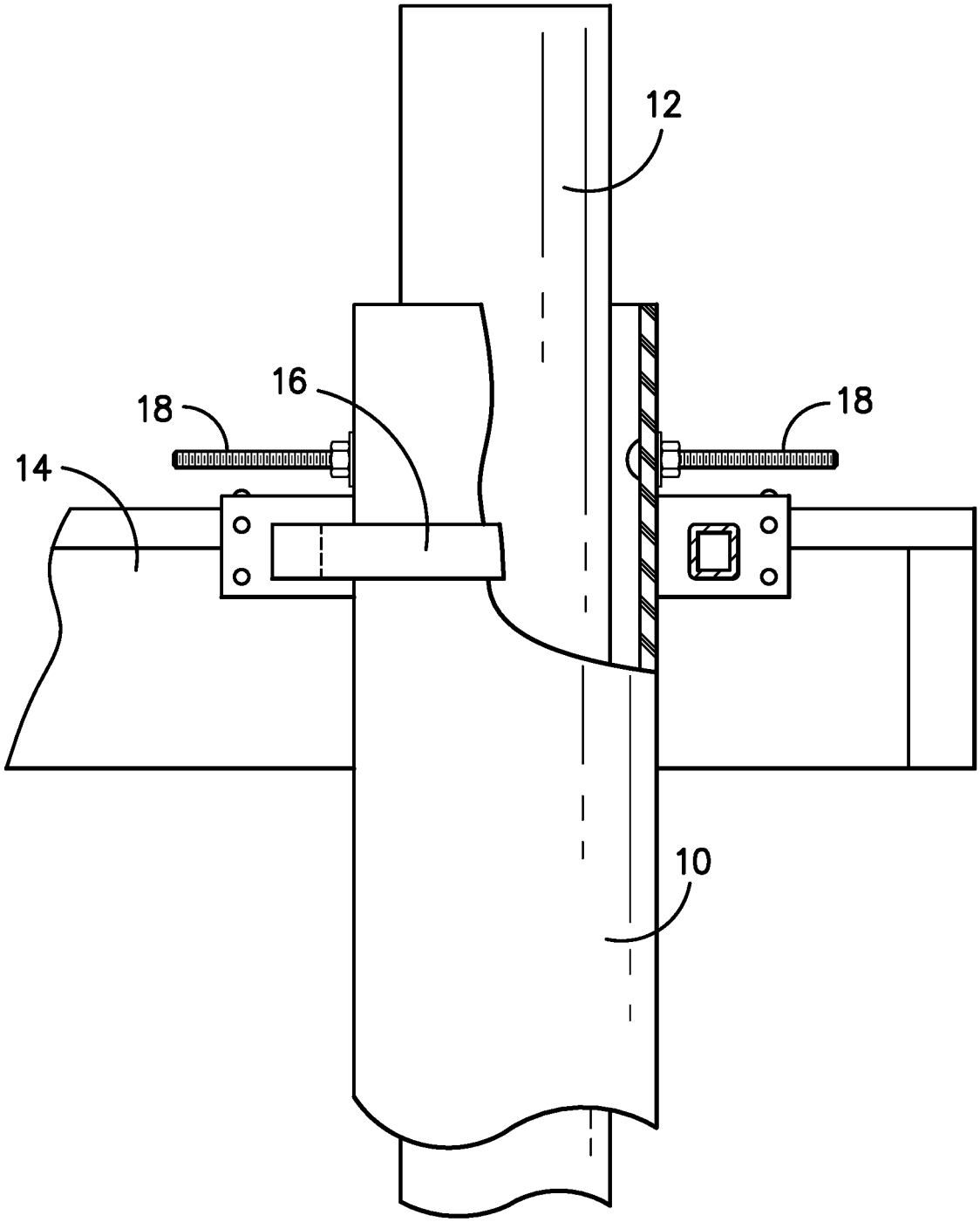
FIG. 5 is a side cutaway view of the embodiment of the piling sleeve assembly shown in FIGS. 1-4.
Figure 6:
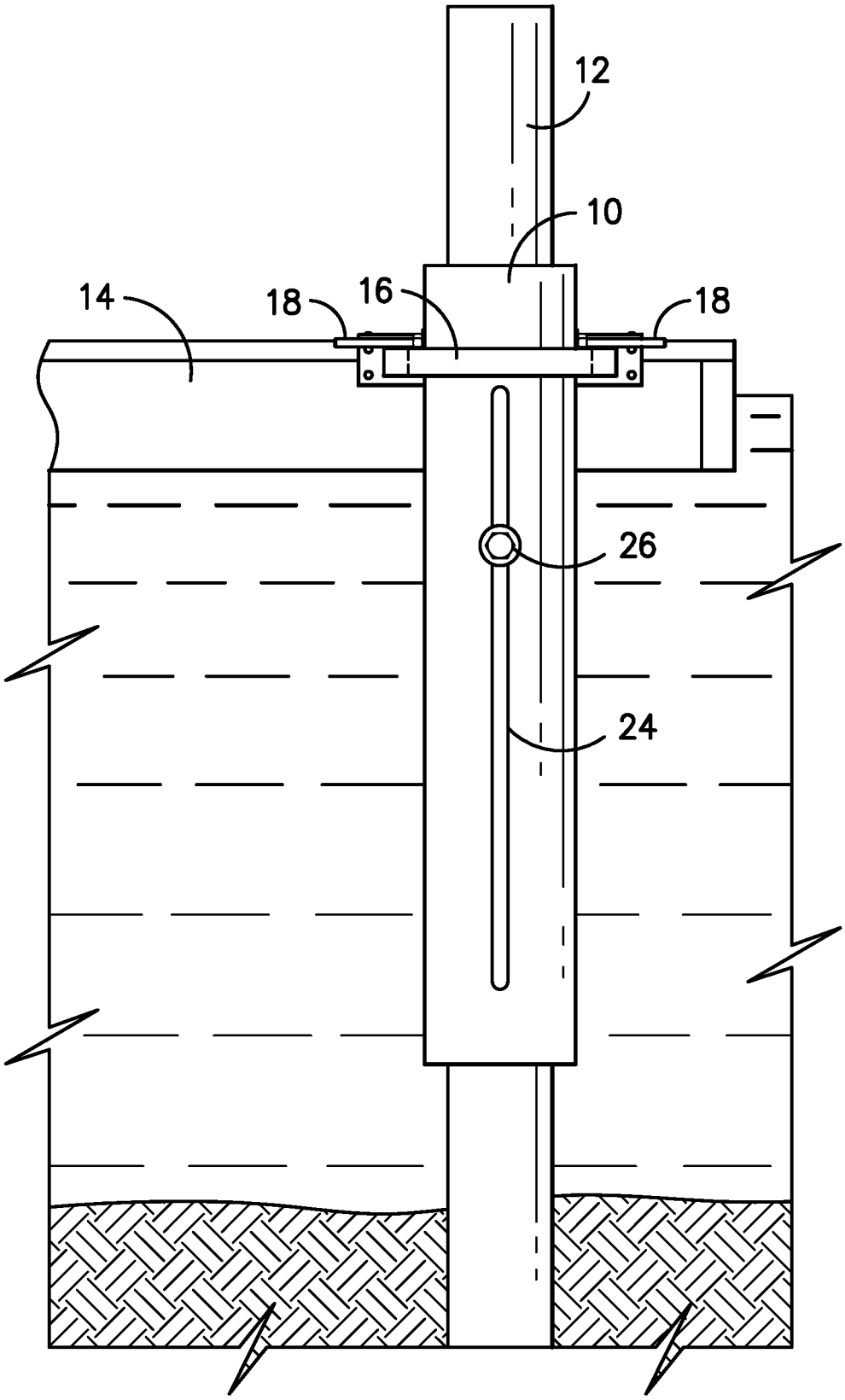
FIG. 6 is a side view of an alternate embodiment of the piling sleeve assembly, wherein the piling sleeve includes a longitudinally oriented slit, and wherein a bolt is driven through the slit and into the piling, in order to secure the piling sleeve to the piling while allowing the piling sleeve to move upwardly and downwardly with respect to the piling.
Figure 7:
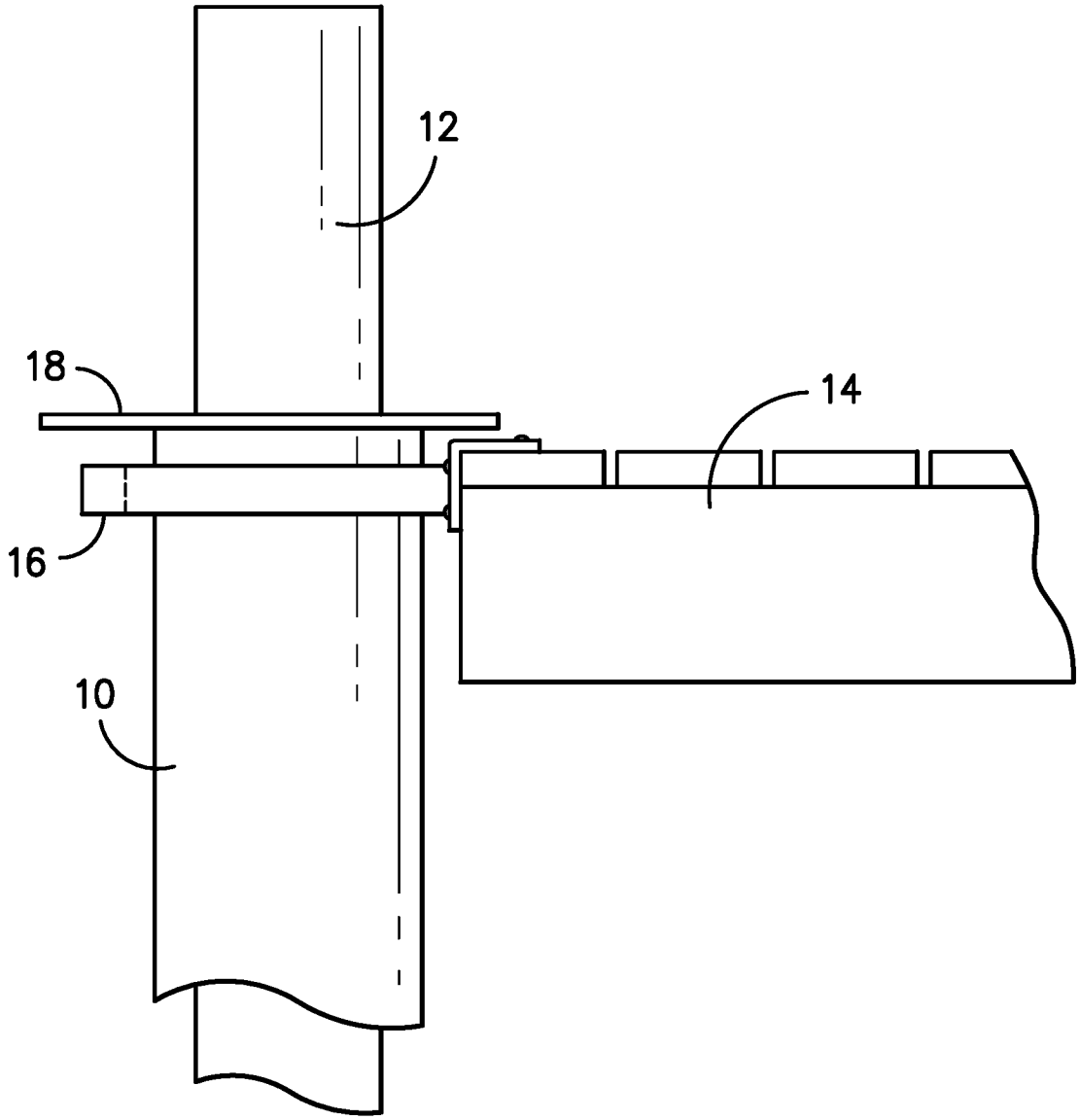
FIG. 7 is a side view of another alternate embodiment of the piling sleeve assembly, wherein the catch mechanism is an outwardly extending flange around the top of the piling sleeve.

The catch mechanism 18 is designed to "catch" or engage the U-brace 16 on the floating dock 14 when the dock 14 rises with the water to a pre-determined level, so that if the water rises above the predetermined level, the piling sleeve 10 may rise along with the floating portion of the dock 14. The catch mechanism 18 may take many forms, including a flange around an upper portion of the piling sleeve (as shown in FIGS. 7 and 10), a lip, a rod or bolt (or a series of rods or bolts) extending from one side of the piling sleeve as shown in FIGS. 1-6 and 8-9, or any other suitable arrangement, so long as it extends radially away from the piling sleeve 10 to engage the upper periphery of the U-brace 16. The piling sleeve 10 is positioned so that at least an upper portion thereof remains above the top surface (floor) of the floating dock 14, and the piling sleeve 10 extends downwardly through the piling opening in the U-brace 16, and extends downwardly below the dock 14 and below the surface of the water, surrounding the piling 12.

Figure 2:
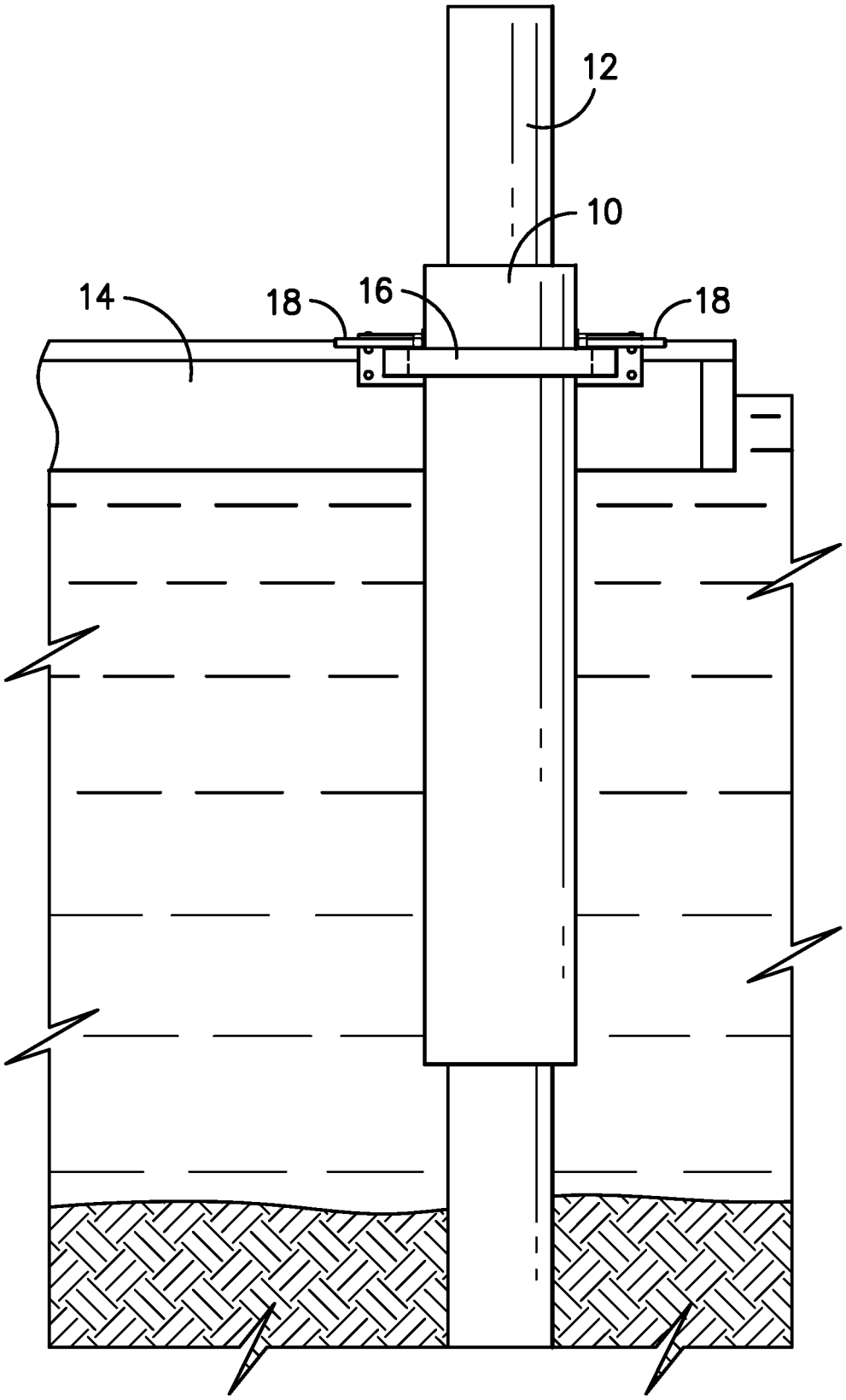
FIG. 2 is a side view of the piling sleeve assembly shown in FIG. 1 when the water level is at a normal level so that the floating portion of the dock is afloat, and the catch mechanism is engaged with the U-brace so that the piling sleeve is disposed above the lake or ocean bottom surface beneath the dock.
Figure 3:
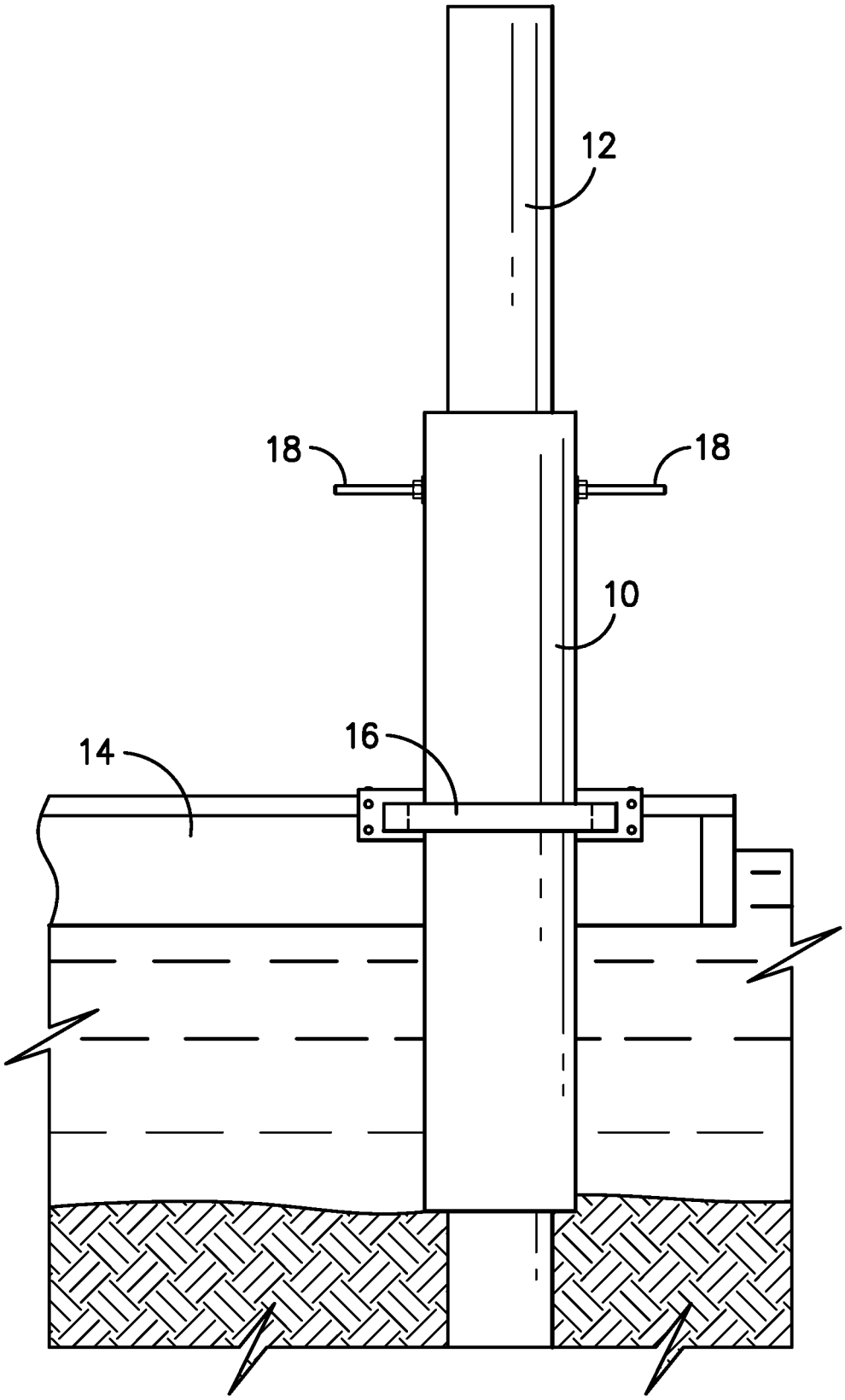
FIG. 3 is a side view of the piling sleeve assembly shown in FIG. 1 when the water level is at a lower level than that shown in FIG. 2, so that the piling sleeve is resting on the lake or ocean bottom, and wherein the floating dock is afloat in shallow water.

This arrangement allows the floating portion of the dock 14 to rise and fall with fluctuations in the water level, and further, allows for the piling sleeve 10 to slide upwardly and downwardly along the vertically oriented piling 12, as well. If the water level becomes low enough, then the bottom of the piling sleeve 10 may simply rest on the ground around the piling, and the floating portion of the dock 14 may continue descending until it rests on the ground, as well. As the water begins to rise from such a low level, the dock 14 begins to float while the bottom of the piling sleeve 10 continues to rest on the ground around the piling 12 as shown in FIG. 3. When the water level rises to the level where the catch mechanism 18 engages with the U-brace 16 on the floating portion of the dock, then the piling sleeve 10 begins to rise along with the floating portion of the dock 14, as shown in FIG. 2.

Figure 4:
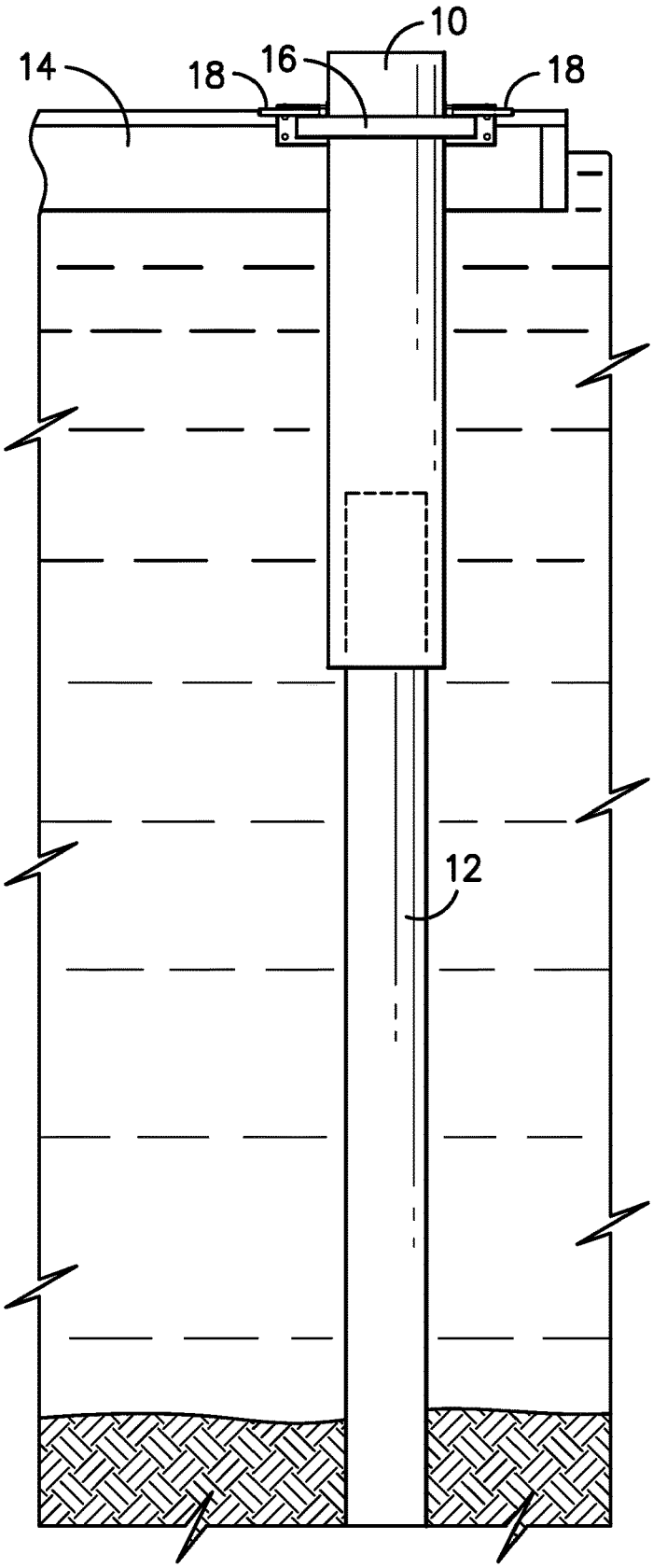
FIG. 4 is a side view of the piling sleeve assembly shown in FIG. 1 when the water level is at a high flood level, wherein the piling is completely submerged, the catch mechanism is engaged with the U-brace, and the piling sleeve is maintaining contact between the floating dock and the submerged piling in order to maintain a secure connection between the piling and the floating dock.

When the water rises above flood level (or a designated high water mark), then the piling sleeve 10 remains engaged with the dock 14 due to the catch mechanism 18. In the event that the water rises to a level where the piling 12 is submerged, and is no longer protruding through the piling opening in the U-brace 16, the piling sleeve 10 remains positioned within the piling opening in the U-brace 16, and the lower part of the piling sleeve 10 remains engaged with the upper portion of the fixed piling 12, as shown in FIG. 4. In this way, the piling sleeve 10 serves to extend the reach of the piling 12 through the piling opening in the U-brace 16, and prevents the floating portion of the dock 14 from completely disengaging with the piling 12. It should be understood, in this embodiment, that the piling sleeve 10 may freely move upwardly and downwardly with respect to both the floating dock 14 and the piling 12, and is not immovably fixed to either the floating dock 14 or the piling 12.

This arrangement also allows the piling sleeve assembly to be added to an existing floating dock 14 and piling 12 structure, and is not required to be employed during construction of the dock and piling assembly. Indeed, the piling sleeve assembly may optionally be employed only during storms, hurricanes, floods, or the like, and removed thereafter, or it may be employed for everyday use, as desired.

Figure 9:
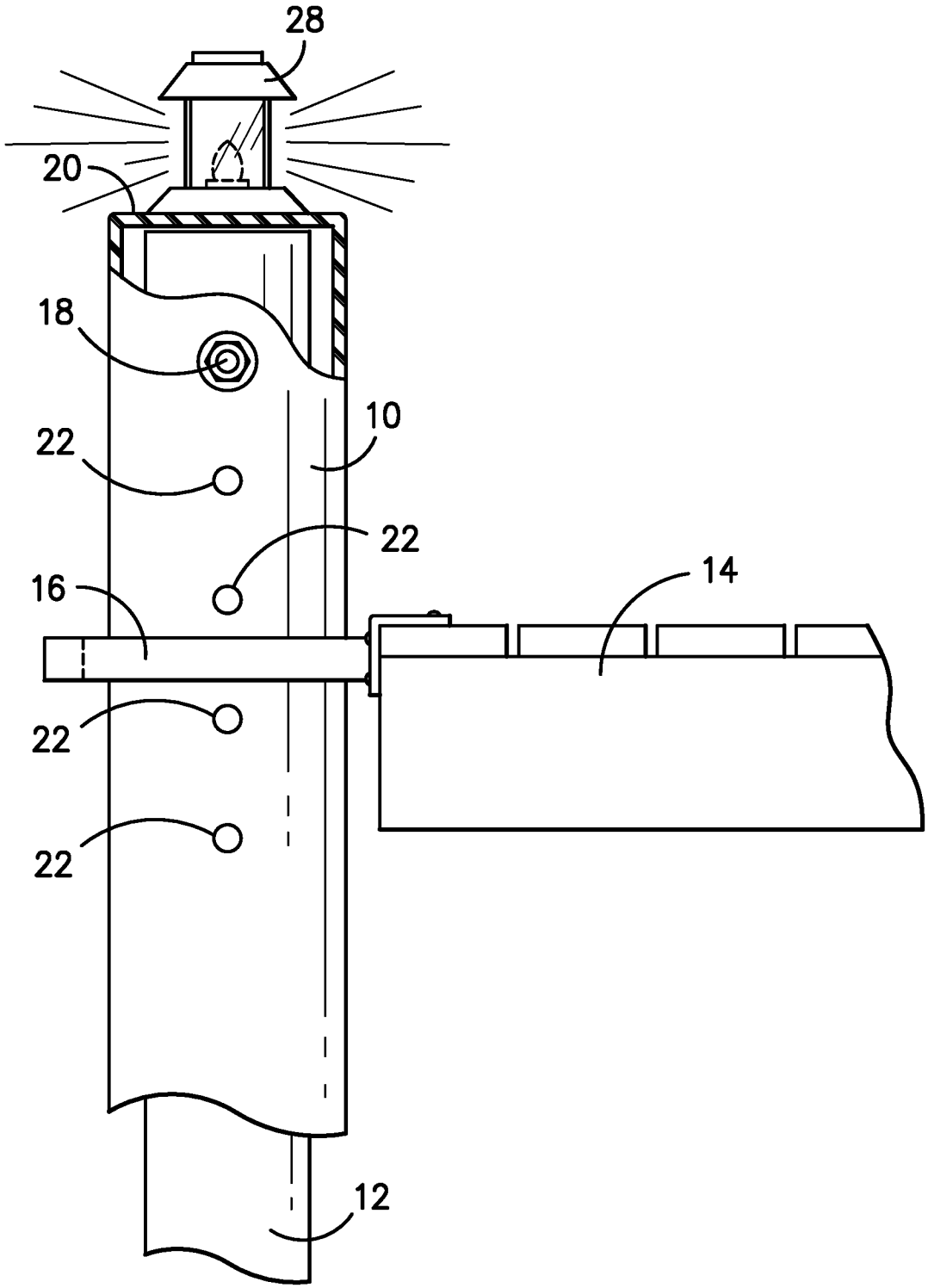
FIG. 9 is a cutaway side view of another alternate embodiment of the piling sleeve assembly, wherein the piling sleeve including a cap on an upper portion thereof, and a light mounted on the top of the cap.
Figure 10:
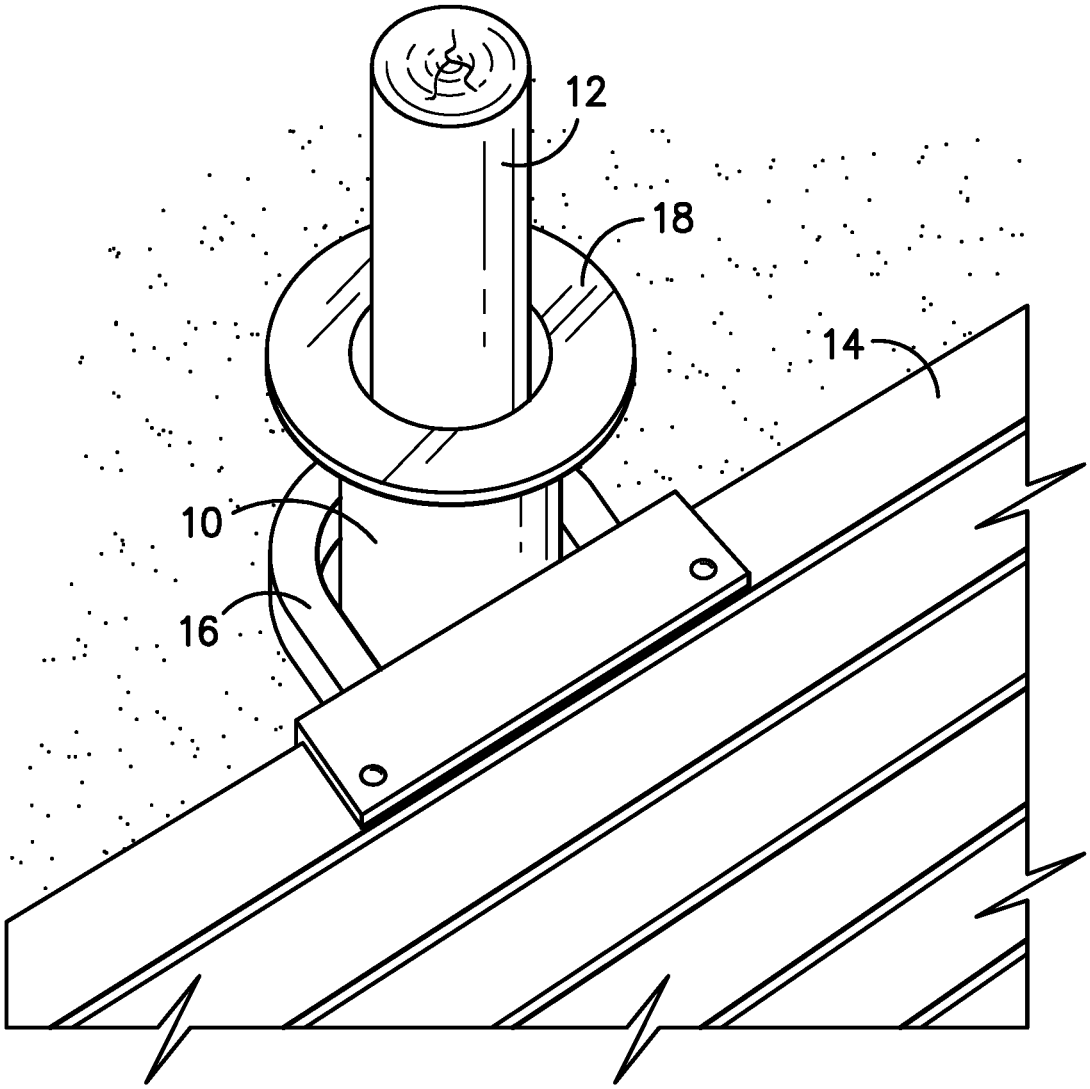
FIG. 10 is a perspective view of the piling sleeve assembly shown in FIG. 7, wherein the catch mechanism is a flange around an upper portion of the piling sleeve.

In one alternative embodiment, the piling sleeve 10 may include a cap 20 on an upper portion thereof, so that the cap 20 restricts the sleeve from sliding down along the piling 12 when the piling 12 and cap 20 are in contact with each other, as shown in FIG. 9.

In another alternative embodiment, the catch mechanism 18 may be adjustable, so that the catch mechanism 18 may be moved upwardly or downwardly and secured with respect to the piling sleeve 10. For example, if the catch mechanism 18 takes the form of a rod or bolt, then the piling sleeve 10 may include a series of holes 22 oriented in a vertical line, and the rod or bolt catch mechanism 18 may be inserted and secured into any of the holes 22, as desired, in order to adjust the predetermined water level at which the catch mechanism 18 engages the floating dock 14 and begins to float along therewith. This embodiment is shown in FIG. 9. In order to attach the rod or bolt catch mechanism 18 to the appropriate hole 22, one end of the rod or bolt may be threaded, and the threaded end is positioned within the hole with a nut (and preferably, a washer) secured on either side of the hole in the piling sleeve 10, as shown in FIG. 5. Alternatively, snap-fit mechanisms may be used. Of course, it should be understood that other vertical height adjustment means may be used to adjust the vertical position of the catch mechanism 18 with respect to the piling sleeve 10, and those skilled in the art will recognize and understand such height adjustment mechanisms that may be employed for such a purpose.

Optionally, the piling sleeve assembly may include means for tethering or connecting the piling sleeve 10 to the piling 12. Tethering means may include a rope or cable that is attached to an eyelet affixed to the piling sleeve 10, and further attached around or to the piling 12. Alternately, a slide mechanism may be employed for such purposes, wherein the piling sleeve 10 includes a longitudinal slit 24 along one side thereof, and a lag bolt 26, screw, or the like may be driven through the longitudinal slit 24 from an outside of the piling sleeve 10 and into the piling 12, as shown in FIG. 6. In this embodiment, the piling sleeve 10 may slide upwardly and downwardly with respect to the piling 12, but the piling sleeve 10 remains slidably attached thereto, because the lag bolt 26 prevents the piling sleeve 10 from becoming completely disengaged from the piling 12.

Figure 8:
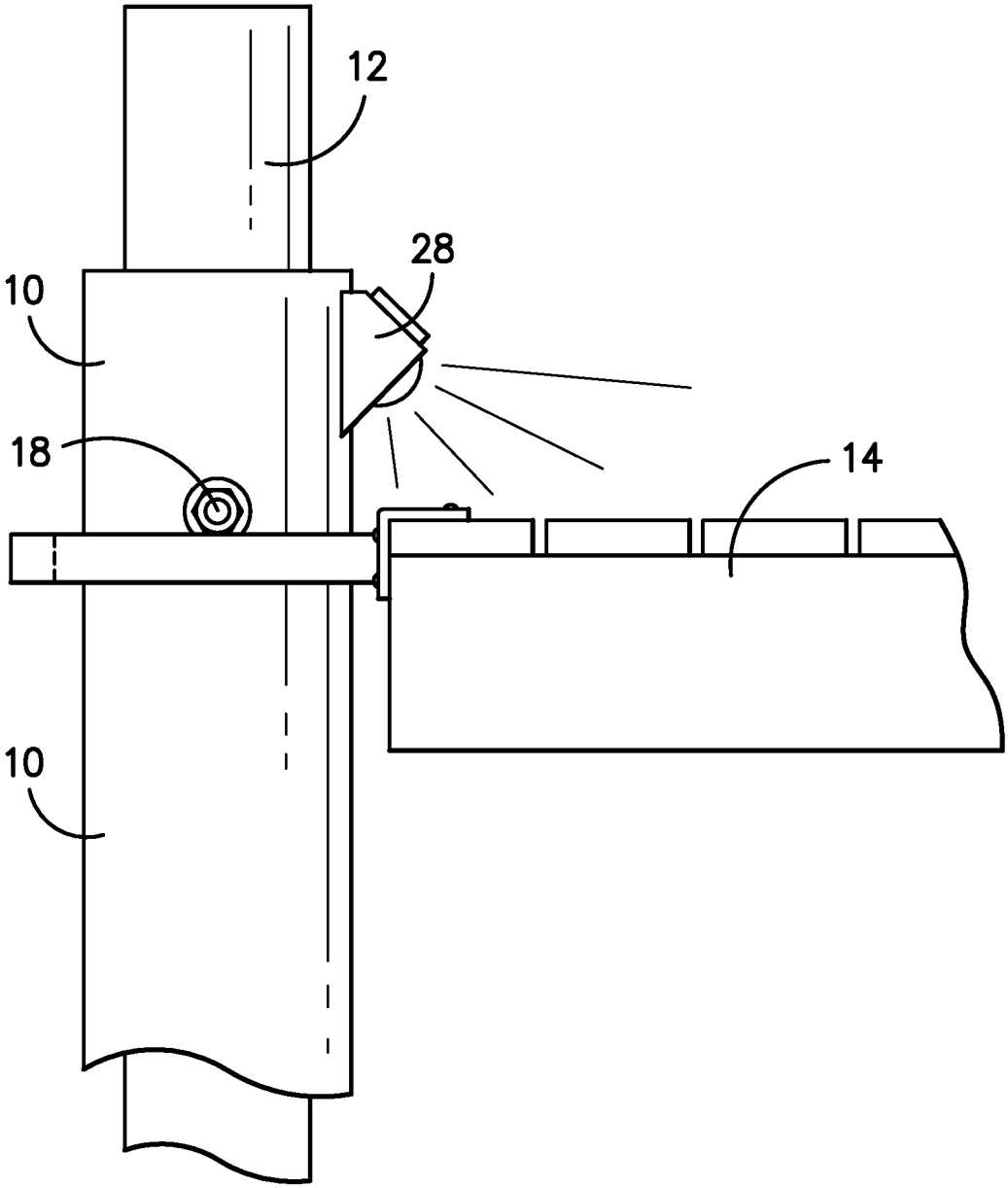
FIG. 8 is a side view of another alternate embodiment of the piling sleeve assembly, further including a solar light attached to an upper portion of the piling sleeve.

Other optional features may include one or more lights 28 attached to the piling sleeve 10 on an upper portion thereof. For example, solar lights 28 are commonly used on docks 24, and a solar light 28 may be attached to the piling sleeve 10 in any desired location, preferably above the level of the catch mechanism 18. Examples are shown in FIGS. 8 and 9. It should be understood that any type of light may be attached to the piling sleeve in any desired location or position, and the benefit of a solar light is simply that no additional wiring is required.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What I claim is:

1. A telescoping piling assembly for floating docks comprising:

a piling sleeve having a hollow portion disposed longitudinally within said sleeve; and a catch mechanism attached to said piling sleeve, wherein said catch mechanism extends radially outwardly from said piling sleeve; wherein said piling sleeve is placed around a piling in telescopic relation so that said piling sleeve freely slides upwardly and downwardly with respect to said piling, and so that said piling sleeve slides upwardly and downwardly with respect to said floating portion of said dock; and wherein said catch mechanism engages a floating dock when a water level where said floating portion of said dock is positioned reaches a predetermined vertical level.

2. The telescoping piling assembly for floating docks set forth in claim 1, wherein said catch mechanism is selected from the group consisting of a rod, bolt, lip, and flange.

3. The telescoping piling assembly for floating docks set forth in claim 1, further including a light attached to said piling sleeve.

4. The telescoping piling assembly for floating docks set forth in claim 1, further including a longitudinal slit positioned on a side of said piling sleeve.

5. A floating dock piling height extension assembly comprising:

a dock, wherein said dock includes a floating portion;

said floating portion of said dock including a piling opening therein;

a fixed, vertically oriented piling extending from a ground surface through said piling opening in said floating portion of said dock;

a piling sleeve positioned around said piling, so that said piling sleeve freely slides upwardly and downwardly with respect to said piling and said floating portion of said dock;

a catch mechanism attached to said piling sleeve, said catch mechanism extending radially from said piling sleeve so that when said floating portion of said dock is floating in water, and said water rises to a predetermined level, said catch mechanism engages with said floating portion of said dock, and said piling sleeve rises with said floating portion of said dock.

6. The floating dock piling height extension assembly set forth in claim 5, wherein said catch mechanism is selected from the group consisting of a rod, bolt, lip, and flange.

7. The floating dock piling height extension assembly set forth in claim 5, further including a light attached to said piling sleeve.

8. The floating dock piling height extension assembly set forth in claim 5, further including a longitudinal slit positioned on a side of said piling sleeve.

9. A method for maintaining a connection between a floating dock and a piling during flood events, said method comprising the steps of:

providing a floating dock assembly comprising a floating dock, wherein said floating dock includes an enclosed piling opening, and wherein a fixed piling extends upwardly from a ground surface beneath said floating dock and through said piling opening;

telescopically sliding a piling sleeve around an outer portion of said fixed piling, so that said piling sleeve slides upwardly and downwardly around said fixed piling and with respect to said floating dock; and providing a catch mechanism attached to said piling sleeve, so that said catch mechanism engages a surface of said floating dock when water where said dock is floating rises to a predetermined level.

10. The method for maintaining a connection between a floating dock and a piling during flood events set forth in claim 9, wherein said catch mechanism is selected from the group consisting of a rod, bolt, lip, and flange.

11. The method for maintaining a connection between a floating dock and a piling during flood events set forth in claim 9, further including the step of providing a light attached to said piling sleeve.

12. The method for maintaining a connection between a floating dock and a piling during flood events set forth in claim 9, further including the steps of:

providing a longitudinal slit along said piling sleeve; and driving a bolt through said longitudinal slit and into said piling, so that said piling sleeve slides upwardly and downwardly along said piling, and so that said piling sleeve is slidably secured to said piling.

* * * * *